United States Patent [19]

Helterbrand et al.

[11] Patent Number: 4,756,127

[45] Date of Patent: Jul. 12, 1988

[54] UNIVERSAL FRAMING SYSTEM FOR GLAZING AND METHOD OF USING SAME

[75] Inventors: Arlen Helterbrand; Patrick J. Holthaus, both of Pana, Ill.

[73] Assignee: National Greenhouse Company, Pana, Ill.

[21] Appl. No.: 869,081

[22] Filed: May 30, 1986

[51] Int. Cl.[4] ..... E04B 7/02

[52] U.S. Cl. ..... 52/90; 52/92; 52/397; 52/475

[58] Field of Search ..... 52/781, 90, 92, 461, 52/464, 94, 235, 395, 242, 732, 397, 475, 398, 204, 209; 47/17

[56] References Cited

U.S. PATENT DOCUMENTS

| | | | |
|---|---|---|---|
| 3,147,518 | 9/1964 | Horgan, Jr. | 52/235 X |
| 3,367,077 | 2/1968 | Johnston | 52/397 X |
| 3,380,210 | 4/1968 | Neal et al. | 52/235 |
| 3,436,887 | 4/1969 | Grossman | 52/235 |
| 3,720,025 | 3/1973 | Eichman | 52/204 |
| 4,055,923 | 11/1977 | Biebuyck | 52/397 X |
| 4,057,941 | 11/1977 | Schwartz | 52/92 X |
| 4,069,627 | 1/1978 | Pegg | 52/92 |
| 4,070,806 | 1/1978 | Hubbard | 52/729 X |
| 4,114,330 | 9/1978 | Sukolies | 52/461 |
| 4,478,013 | 10/1984 | Tavano | 52/461 X |
| 4,571,899 | 2/1986 | Minter | 52/467 X |

OTHER PUBLICATIONS

A 9-page compilation of drawings dated Jan. 16, 1985, relating to a Glazing System for "Botanic Garden Conservatory Complex."

*Primary Examiner*—Carl D. Friedman

*Attorney, Agent, or Firm*—Senniger, Powers, Leavitt and Roedel

[57] ABSTRACT

A universal framing system is disclosed adapted for use with glazing having substantially any thickness within a wide range of thicknesses. The system comprises an elongate eave member having a top wall, a first flange depending from the top wall and extending longitudinally of the eave member generally adjacent the front of the eave member, and a second flange depending from the top wall and extending longitudinally of the eave member generally parallel to the first flange. The second flange is spaced rearwardly from the first flange whereby the upper edge margin of a sheet of wall glazing may be inserted upwardly between the flanges, the spacing between the flanges being sufficient to accommodate a sheet having substantially any thickness within said range of thickness. A holder on the first flange is provided for holding a first flexible sealing member in position for sealing engagement with the front face of said sheet. The system also includes a unique sill member, side and roof bars, corner bars and various other components which are adapted to accommodate substantially any type and thickness of glazing. A method of using the system is also disclosed.

22 Claims, 4 Drawing Sheets

UNIVERSAL FRAMING SYSTEM FOR GLAZING AND METHOD OF USING SAME

BACKGROUND OF THE INVENTION

This invention relates generally to framing systems and, more particularly, to a universal framing system for use with glazing having substantially any thickness within a wide range of thicknesses.

The framing system of this invention has particular (albeit not exclusive) application to the installation of glazing in greenhouses. In conventional construction of greenhouses, it is necessary to use framing for the glazing having components which are especially sized and configured to the particular type and thickness of glazing material to be used. These components are typically of extruded aluminum and include glazing bars for the sides and roof of the greenhouse, eave members, sill members, corner bars, and a variety of other fittings. For each type and thickness of glazing material, it has heretofore been necessary to use framing components of particular configurations and dimensions especially adapted for use with that material. This causes complications, undue expense, and potential confusion, particularly in jobs where different glazing materials are used in different sections of the same building.

SUMMARY OF THE INVENTION

Among the several objects of this invention may be noted the provision of a universal framing system having components which are adapted for use with substantially any type and thickness of glazing material within a wide range of thicknesses (e.g., $\frac{1}{8}$ in. to $\frac{5}{8}$ in.); the provision of such a system which minimizes the number of different component parts to reduce the number of different parts which have to be made and stocked; the provision of such a system which can accommodate different types and thicknesses of glazing material used in the same building; the provision of such a system which is easy to install, which minimizes confusion during installation, and which provides excellent seals between the glazing and the component parts of the system; and the provision of a method for using the universal framing system of this invention.

In a first aspect of this invention, the universal framing system comprises an elongate eave member having a top wall, a first flange depending from the top wall and extending longitudinally of the eave member generally adjacent the front of the eave member, and a second flange depending from the top wall and extending longitudinally of the eave member generally parallel to the first flange. The second flange is spaced rearwardly from the first flange whereby the upper edge margin of a sheet of wall glazing may be inserted upwardly between the flanges to a position in which the sheet lies in a generally vertical plane generally parallel to the flanges. The spacing between the flanges is sufficient to accommodate a sheet having substantially any thickness within said range of thickness. Means is provided on said first flange for holding a first flexible sealing member in position for sealing engagement with the front face of the sheet.

In a second aspect of this invention, the universal framing system comprises a corner bar having first and second exterior walls extending generally at right angles with respect to one another, an interior leg extending inwardly from the second exterior wall generally parallel to the first exterior wall and spaced therefrom for receiving therebetween an edge margin of a first sheet of glazing extending in a plane generally parallel to the first exterior wall and interior leg, the spacing between the first exterior wall and interior leg being sufficient to accommodate a sheet of glazing having substantially any thickness within a wide range of thicknesses, and means on the first exterior wall for holding a first sealing member in position for sealing engagement with one face of the sheet of glazing.

In a third aspect of the invention, the universal glazing system comprises a glazing bar having in transverse section a web, a pair of legs extending laterally from the web on opposite sides of the web adjacent one end of the web, constituting its inner end, a head at the other end of the web, constituting its outer end, and a pair of arms extending generally at right angles from the web on opposite sides of the web at a location between the head and the legs, the arms being generally coplanar along substantially their entire lengths and being adapted for flatwise supporting engagement with edge margins of adjacent sheets of glazing. The system further comprises an elongate cap member having longitudinally extending side margins, and means for securing the cap member to the head of the glazing bar in a position in which the side margins of the cap member are spaced outwardly from the arms of the glazing bar for receiving therebetween the edge margins of the sheets of glazing.

In still another aspect of this invention, the universal glazing system comprises a sill member having a top wall adapted for supporting the lower end of a vertical side wall member of the system, a rear wall at the rear of the sill member, a front wall having a ledge projecting forwardly therefrom at a level below the top wall for supporting the lower edge of a vertical sheet of wall glazing, and a structure on the front wall of generally inverted-channel shape in transverse section comprising a web and a pair of depending generally parallel flanges extending longitudinally of the sill member, one flange constituting a front flange and the other a rear flange, the flanges being spaced from one another for receiving therebetween an edge margin of a sheet of wall glazing lying in a generally vertical plane running generally parallel to the flanges, the spacing between the flanges being sufficient to accommodate a sheet of glazing having substantially any thickness within said range of thicknesses, and means on the front flange for mounting a flexible sealing member in position for sealing engagement with the front face of said sheet.

One aspect of the method of this invention involves an eave member of the type described above. More specifically, the method comprises the steps of supporting the eave member on suitable structural framing, providing a set of one or more sealing members sized and configured to accommodate a selected sheet of glazing having a particular thickness, mounting a first sealing member of the set on the front flange of the eave member, and inserting the upper edge margin of a sheet of glazing upwardly between the flanges into a position in which the first sealing member is in sealing engagement with the front face of said sheet.

Another aspect of the method involves a corner member of the type described above. Specifically, the method comprises the steps of supporting the corner bar on suitable structural framing, providing a set of one or more sealing members sized and configured to accommodate a selected sheet of glazing having a particular thickness, mounting a first sealing member of the set on the first exterior wall of the corner bar, and inserting an edge margin of the aforesaid first sheet of glazing between the first exterior wall and interior leg into a position in which the first sealing member is in sealing engagement with the exterior face of the sheet.

Other objects and features will become in part apparent and in part pointed out hereinafter.

BRIEF DESCRIPTION OF THE DRAWINGS

Corresponding parts are indicated by corresponding reference numerals throughout the several views of the drawings.

DESCRIPTION OF THE PREFERRED EMBODIMENT

Figure 1:
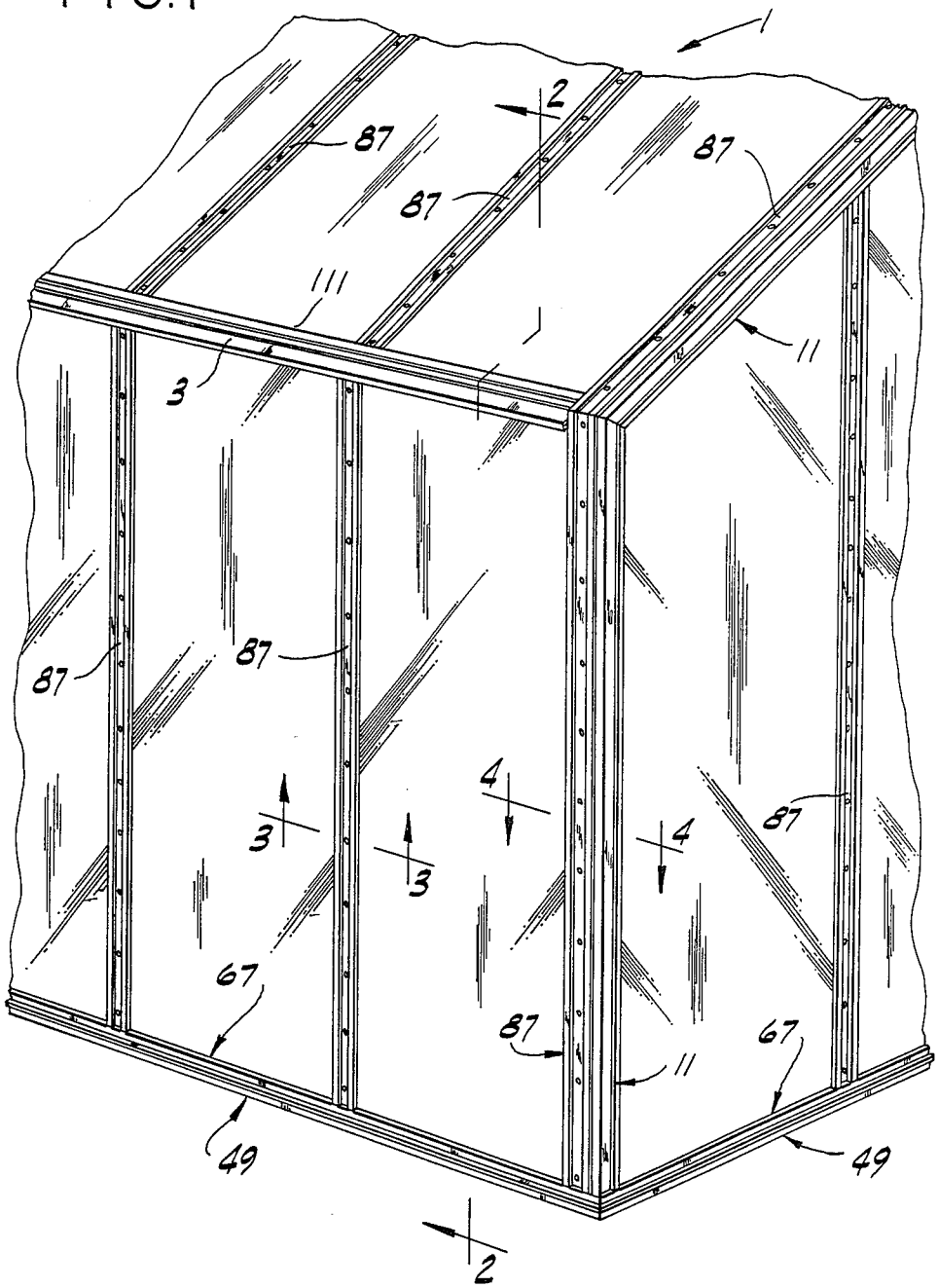
FIG. 1 is a perspective of a portion of a building (e.g., a greenhouse) using the universal framing system of this invention.

Referring now to the drawings, and first more particularly to FIG. 1, an end portion of a building (e.g., a greenhouse) constructed using the universal framing system of the present invention is indicated generally at 1. The framing system comprises a plurality of different framing components, including an eave member generally designated 3 (FIG. 2), a sill member generally designated 5, a side bar generally designated 7, a roof bar generally designated 9, a corner bar generally designated 11 (FIG. 4), and various other components, which are secured by bolts or other fasteners to the structural framing 13 of the building (indicated in phantom in the drawings) in appropriate fashion to support glazing in place on the building. These various components are sized and configured for use with glazing having substantially any thickness within a wide range of thicknesses (e.g., $\frac{1}{8}$ in. to $\frac{5}{8}$ in.), thereby minimizing the number of different types of components which must be made and stocked.

Figures 2, 3:
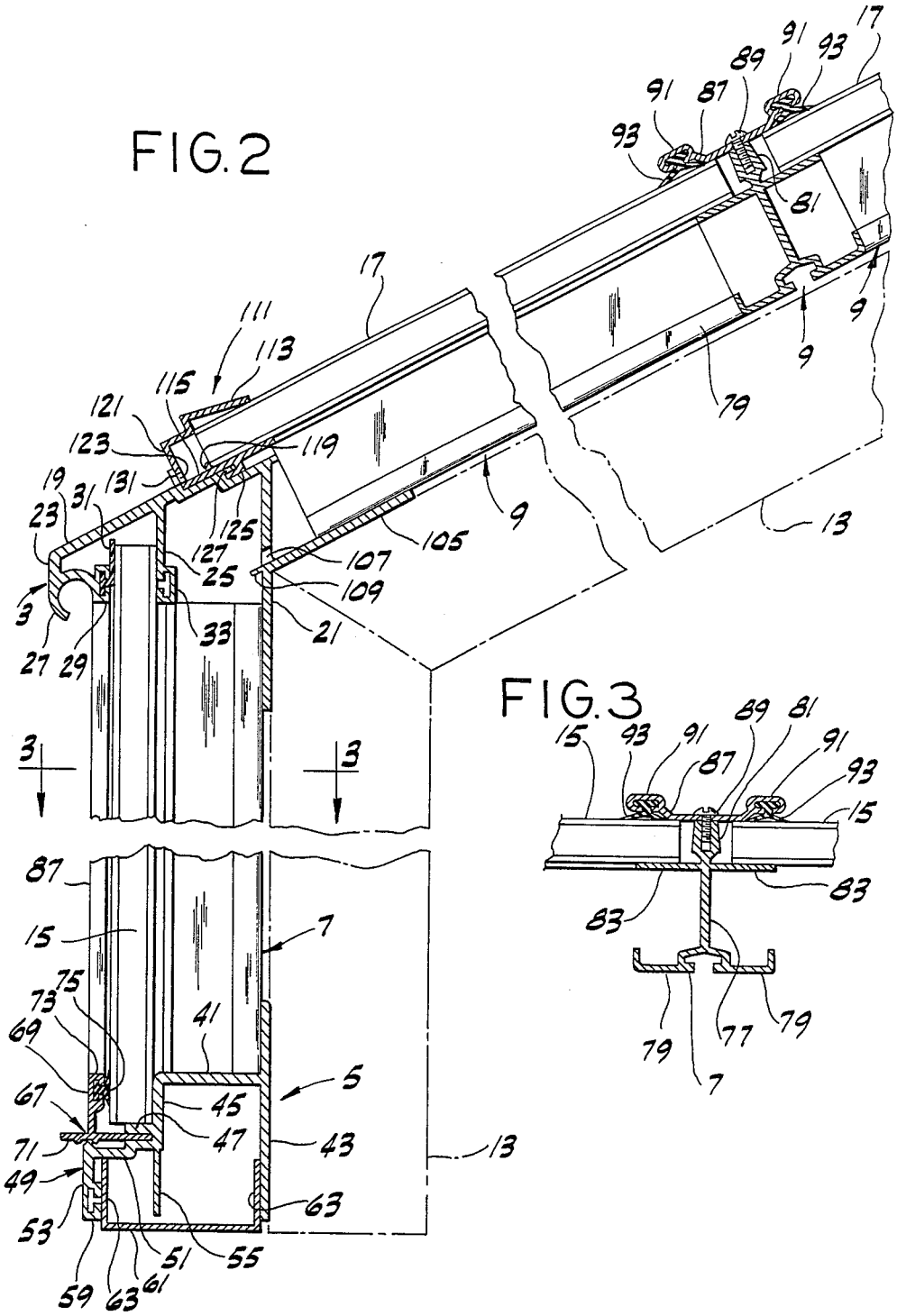
FIG. 2 is an enlarged vertical section taken on line 2—2 of FIG. 1.
FIG. 3 is a horizontal section taken on line 3—3 of FIGS. 1 and 2.

Referring now to FIG. 2, there is shown in vertical section an assembly of an elongate eave member 3, which runs along the building at the juncture of the roof and front wall of the building, an elongate sill member 5 generally parallel to and spaced below the eave member, a side bar 7 extending vertically between the eave and sill members, and a gridwork of roof bars, each designated 9. These components support sheets of wall glazing 15 and roof glazing 17, the glazing shown being $\frac{5}{8}$ in. structural glazing of the type sold under the trade designation "Exolite" by Cyro Industries of Sanford, Maine. As will appear, the spacing between the side bars 7 at the sides of the building and the spacing between the sloping roof bars 9 on the roof of the building is somewhat greater than the standard width of the sheets of glazing, which may be 4 feet, for example.

More specifically, the eave member 3 is an extruded member of aluminum, for example, having a top wall 19 and a vertical rear wall 21 suitable fastened, as by bolts, to the structural framing 13 of the building. As shown in FIG. 2, the top wall 19 slopes generally downwardly from the rear wall to the front (left as viewed in FIG. 2) of the member. A first (front) flange 23 depends from the top wall 19 generally adjacent the front of the eave member and runs the length of the eave member. A second (rear) flange 25 also depends from the top wall and runs the length of the eave member generally parallel to the front flange 23. These flanges are spaced from one another for receiving therebetween the upper edge margin of glazing sheet 15, which lies in a generally vertical plane running generally parallel to the flanges. The spacing between the flanges 23, 25 is sufficient to accommodate a sheet of wall glazing having substantially any thickness within a wide range of thicknesses (e.g., $\frac{1}{8}$ in. to $\frac{5}{8}$ in.).

Figure 5:
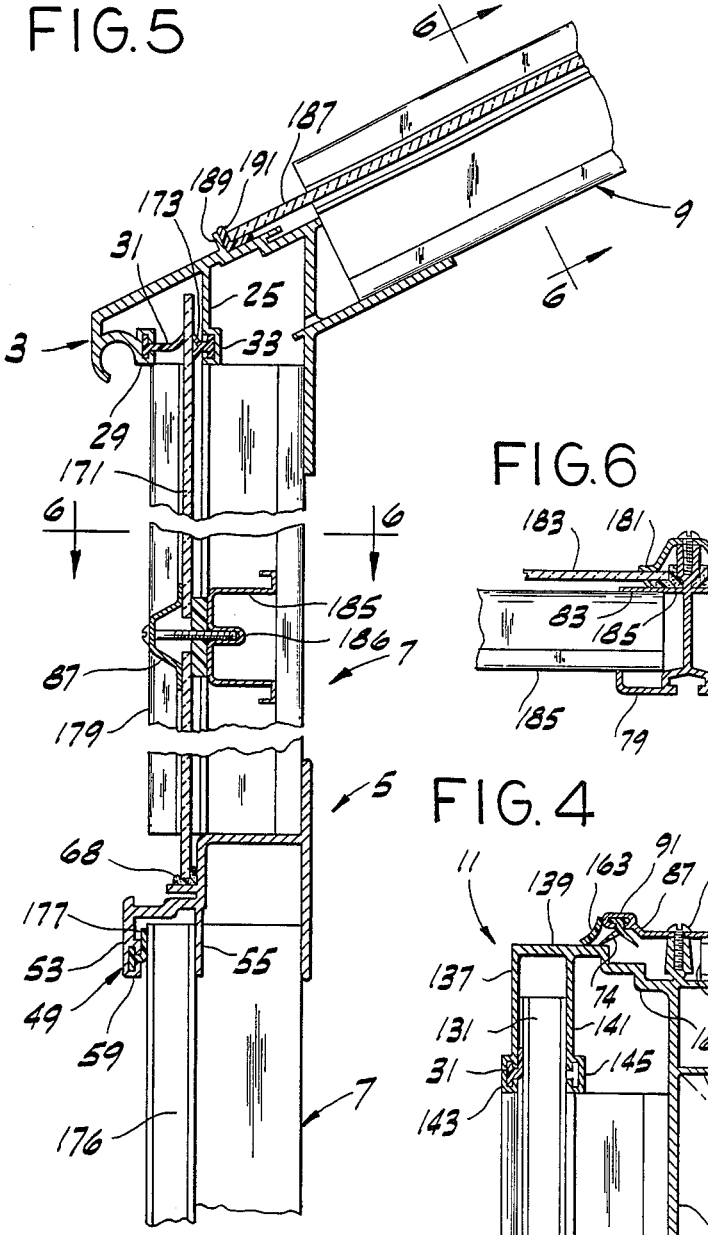
FIG. 5 is a view similar to FIG. 2 showing the system adapted for a different type and thickness of glazing.

A part-circular pivot or hinge 27 is formed at the lower end of the front flange 23 and serves a function which will be described later. The rearward (right) portion of this pivot is formed with an integral channel-shaped holder 29 which extends longitudinally of the eave member. The holder 29 opens rearwardly and constitutes means for holding a first sealing member 31 in position for sealing engagement with the front or outer face of the sheet 15 adjacent its upper edge. The sealing member may be of any suitable flexible and resilient sealing material. As shown, it is preferably T-shaped in cross-section, having a relatively short crosshead received in channel 29 and a relatively long tongue engageable with the front face of the glazing. The tongue of the sealing member 31 should be sufficiently long to seal against a relatively thin sheet of glazing (e.g., a $\frac{1}{8}$ in. thick sheet), as shown in FIG. 5.

A channel-shaped holder 33 is also integrally formed with the rear flange 25 adjacent the lower end of the flange. This holder 33 runs the length of the eave member generally parallel to holder 29 and constitutes means for holding a second sealing member when certain types of glazing are used, as will appear. However, when "Exolite" glazing is used, it is generally not necessary to seal against the rear face of the glazing. Accordingly, as shown in FIG. 2, the "Exolite" sheet abuts directly against the rear flange 25 and holder 33.

Again referring to FIG. 2, sill member 5 is an extruded metal member having a generally horizontal top wall 41, a vertical rear wall 43 at the rear of the sill member projecting above the top wall 41 and lying generally in the same vertical plane as the rear wall 21 of the eave member, and a vertical front wall 45 depending from the top wall generally in the same vertical plane as the rear flange 25 of the eave member. A ledge 47 projects forwardly from the front wall 45 at a level below the top wall 41 of the sill member for supporting the lower edge of the sheet 15 of wall glazing, the rearward face of which is adapted to butt up against the front wall 45 of the sill member. The sill member 5 may be secured to the structural framing 13 by any suitable means, such as by bolting the rear wall 43 of the sill member to framing 13.

Indicated generally at 49 at the bottom of the front wall 45 of the sill member is a structure of generally inverted-channel shape having an upper web 51, a front flange 53 depending from the upper web and projecting a short distance above the upper web, and a rear flange 55 lying generally in the same vertical plane as the front wall 45 of the sill member. A channel-shaped holder 59 runs the length of structure 49 at the lower end of the front flange 53 and constitutes means for holding a sealing member (which may be identical to sealing member 31) in position for sealing against the front face of a sheet of glazing (not shown in the FIG. 2 glazing configuration) positioned betwen the flanges 53, 55. In the FIG. 2 construction, a bottom closure channel 61 closes the bottom of the sill member 5, the channel being adapted to rest on a foundation, for example, with its flanges 63 extending vertically upwardly on the inside faces of flange 53 and the rear wall 43 of the sill member.

In the construction shown in FIG. 2, the system further comprises a sealing bar generally designated 67 of angle bar stock having a first vertical leg 69 and a second horizontal leg 71. The rearward end (right end as viewed in FIG. 2) of the horizontal leg 71 has a friction fit between ledge 47 and the top web 51 of structure 49 and the forward (left) end of the leg projects forwardly beyond the vertical leg 69 to form a shelf for reasons which will appear. The upper end of the vertical leg 69 is formed with an integral channel 73 which runs the length of the cap member 67 and which constitutes means for holding a sealing member 75 in sealing engagement with the front face of sheet 15 adjacent its lower edge. As illustrated, this sealing member is formed with a cross-piece received in channel holder 73 and a relatively short V-shaped portion which seals against the front face of the glazing sheet.

The vertical side bars 7 of the system extend between the eave member 3 and sill member 5 at intervals generally corresponding to the width of the sheets 15 of wall glazing. Each side bar is supported on the top wall 41 of the sill member in a position in which the upper end of each bar is disposed immediately forward of the rear wall 21 of the eave member 3 and abutting the bottom of channel 29 and the lower end of the bar is disposed immediately forward of the portion of rear wall 43 of the sill member projecting above the top wall 41 of the sill member. In horizontal transverse section (FIG. 3) each side bar 7 has a web 77, a pair of legs, each designated 79, extending laterally from the web on opposite sides of the web adjacent its inner (or rearward) end, a recessed head 81 projecting endwise from the outer (or forward) end of the web, and a pair of arms, each designated 83, extending generally at right angles from the web on opposite sides of the web at a location between the legs 79 and head 81. As illustrated in FIG. 3, the arms 83 are generally coplanar along substantially their entire lengths (each arm may be 2 in. long, for example) and are adapted for flatwise supporting engagement with edge margins of adjacent sheets 15 of wall glazing, the sheets being disposed on the outside (forward) faces of the arms. It will be noted in this regard that the rear wall 21 of the eave member 3 is spaced from flange 25 a distance such that when the legs 79 of a side bar 7 are positioned on or immediately adjacent the rear wall 21, the arms 83 of the bar are positioned adjacent the inside face of glazing sheet 15 for supporting the latter.

Indicated at 87 is an elongate cap member comprising a relatively wide strip of extruded metal, and means such as screws 89 for securing the cap member to the head 81 of the side bar 7 in a vertical position in which the longitudinally extending side margins of the cap member are spaced outwardly from the arms 83 of the side bar for receiving therebetween the edge margins of the adjacent sheets 15 of wall glazing. The side margins of the cap member 87 as viewed in FIG. 3 are formed with integral channel-shaped holders 91 opening inwardly and carrying sealing members 93 adapted for sealing against the outer faces of the sheets 15. Sealing members 93 may be identical in configuration to sealing member 75.

As in conventional systems, the legs 79 of the side bar are channel-shaped for channeling liquid such as condensate to desired locations.

The roof bars 9 of the framing system shown in FIG. 2 are identical in cross-sectional configuration to the side bars 7 described above, and corresponding parts are identified by corresponding reference numerals. The roof bars are arranged in a grid formation to support sheets 17 of roof glazing, with some roof bars sloping upwardly toward the ridge of the roof and others extending generally at right angles to the sloping roof bars generally parallel to the eave member 3. The lowermost row of sloping roof bars 9 are supported at their lower ends on a rib 105 formed integrally with the rear wall of the eave member 3 and extending the length of the eave member. As illustrated in FIG. 2, the rib slopes upwardly and rearwardly from the rear wall 21 to support the roof bars 9 at the appropriate slope. Drain holes 107 (only one shown) spaced at intervals along the rear wall of the eave member immediately above the rib 105 permit condensate channeled by the legs 79 of the roof bars to drain through the rear wall 21 onto a short lip 109, which directs the liquid forwardly away from the rear wall of the eave member.

As shown best in FIGS. 1 and 2, cap members identical to cap members 87 described above are secured to the heads 81 of the roof bars 9 and carry sealing members 93 which seal against the upper faces of the roof glazing 17.

For relatively thick glazing, such as the "Exolite" glazing shown in FIG. 2, adaptors, each generally designated 111, are used for holding the lowermost row of sheets 17 in fixed position. Each adaptor is an elongate extruded metal member and generally U-shaped in cross section (see FIG. 2) with upper and lower legs indicated at 113 and 115, respectively, spaced apart a distance substantially equal to the thickness of a sheet 17 of roof glazing whereby the lower edge margin of the sheet may be slidably inserted between the legs to the position shown. The upper leg 111 has a bent configuration to provide limited resiliency to the leg to facilitate such insertion and to ensure that the outer edge of the leg remains in contact with the sheet to provide a seal.

As illustrated in FIG. 2, when a sheet 17 of roof glazing is received between the legs 113 and 115 of the adaptor 105, the lower end of the sheet 17 is adapted to butt up against a lip 119 projecting up from the lower leg to hold the sheet spaced from the web 121 of the adaptor and thus out of contact with any liquid which may collect in this area. One or more drain holes 123 are provided in the web 121 of the adaptor for drainage of water from the adaptor.

The lower leg 115 of the adaptor 111 and the top wall 19 of the eave member are formed with interlocking components indicated at 125 and 127, respectively, for releasably attaching the adpator to the eave member. As shown in FIG. 2, the arrangement is such that the adaptor may be installed simply by slidably engaging component 125 with component 127 and removed, if desired, simply by slidably separating the components.

Figure 4:
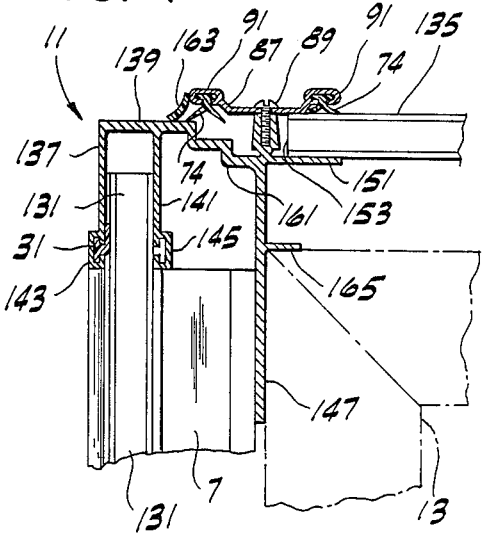
FIG. 4 is an enlarged horizontal section taken on line 4—4 of FIG. 1.

FIG. 4 illustrates a corner bar 11 of the framing system used for supporting sheets 131 and 135 of glazing (e.g., ⅝ in.-thick "Exolite" glazing is shown) generally at right angles with respect to one another. The corner bar has first and second exterior walls indicated at 137 and 139, respectively, extending generally at right angles with respect to one another, and an interior leg 141 extending inwardly from wall 139 generally parallel to wall 137 and spaced therefrom for receiving therebetween an edge margin of glazing sheet 131 extending in a plane generally parallel to the planes of wall 137 and leg 141, the spacing between these latter two components being sufficient to accommodate a sheet of glazing having substantially any thickness within a wide range of thicknesses (e.g., ⅛ in. to ⅝ in.).

The outer (free) end of wall 137 is formed with a channel-shaped holder 143 which runs the length of the corner bar. This holder 143 opens toward the interior leg 141 and constitutes means for holding a sealing member (which may be identical to sealing member 31 in FIG. 2) in position for sealing engagement with the outer face of sheet 131 adjacent its outer edge. A similar channel-shaped holder 145 is also integrally formed at the outer end of the interior leg 141. Holder 145 runs the length of leg 141 generally parallel to holder 143 and constitutes means for holding a second sealing member when certain types of glazing are used, as will appear. However, as noted previously, when thick (e.g., ⅝ in.) glazing is used as shown in FIG. 4, it is generally not necessary to seal against the rear face of the glazing. Under these circumstances the sheet abuts directly against leg 141 and holder 145.

The corner bar 11 also has an interior wall 147 extending inwardly generally at right angles with respect to exterior wall 139 and generally parallel to exterior wall 137 and interior leg 141, the latter being disposed between walls 137 and 147. As shown in FIG. 4, the interior wall 147 is spaced from the interior leg 141 a distance such that when the legs 79 of a side bar 7 (or roof bar 9) are positioned on or immediately adjacent the interior wall, the arms 83 of the bar are positioned adjacent the interior face of glazing sheet 131 for supporting the latter in the manner previously described.

Sheet 135 of glazing is supported by an extension 151 of exterior wall 139 projecting beyond interior wall 147 and having an exterior face which is adapted for flatwise engagement by an edge margin of sheet 135. An elongate cap member 87 of the type previously described is secured by means of screws 89 to a head 153 projecting outwardly from exterior wall 139 generally in-line with interior wall 147 and running the length of the corner bar. The cap member has holders 91 which carry sealing members identical to sealing members 74, one of which sealing members is engageable with outer face of sheet 135 and the other of which is engageable with the outer face of the exterior wall 139. A portion 161 of exterior wall 139 between the interior leg 141 and extension 153 is stepped inwardly, the offset being such that the cap member 87 does not protrude outwardly substantial distance beyond exterior wall 139. An additional seal 163 may be used to seal the gap between holder 91 and the exterior face of wall 139.

A flange 165 projects from the interior wall 147 of the corner bar generally parallel to extension 151 in a direction away from the interior leg 141. This flange is used in connection with relatively thin (e.g., ⅛ in.) glazing, as will be described hereinafter.

FIG. 5 is a view similar to FIG. 2 illustrating how the framing system of this invention may be adapted for use with glazing which is thinner than ⅝ in. "Exolite" glazing, such as ⅛ in. plate glass or 5/16 in. laminated glass. The major component parts of the system, namely, the eave member 3, sill member 5, side bar 7, roof bar 9 and corner bar 11 are as described above and corresponding parts are indicated by corresponding reference numerals. However, for a thinner sheet 171 of wall glazing, holder 33 on flange 25 of the eave member is adapted to hold a sealing member 173 for sealing against the rear (inner) face of the glazing.

Figure 7:
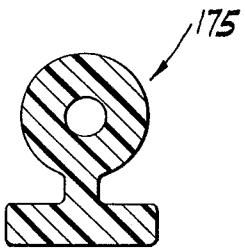
FIG. 7 is a sectional view of a sealing member of the system.

It will be understood that sealing members 31 and 173 may have other suitable configurations depending on the type and thickness of glazing used. Thus, a system of this invention may comprise a plurality of different sets of sealing members, each of which includes one or more sealing members adapted for use with glazing of specified thickness. For example, a sealing member of the type indicated at 175 in FIG. 7 may be used in lieu of sealing member 173 when other types of glazing are used. The important thing to note is that the framing system is adaptable to substantially any type and thickness of glazing within a wide range of thicknesses.

In the glazing configuration shown in FIG. 5, the upper edge margin of a sheet 176 of wall glazing is received between the front and rear flanges 53 and 55 of the sill member structure 49, and a sealing member 177 (which may be identical to sealing member 31) seals against the front face of the sheet. The spacing between flanges 53 and 55 should be sufficient to accommodate glazing having substantially any thickness within a wide range of thicknesses (a relatively thick sheet is shown for purposes of illustration). It will be noted that the spacing between the channel 59 and rear flange 55 is such that when a sheet of ⅝ in.-thick "Exolite" glazing is used, the rear face of the glazing is in substantial face-to-face contact with the inside face of the rear flange 55 to provide the necessary support and seal.

In the FIG. 5 construction, a sealing bar 67 is not used. Instead the bottom edge of the glazing simply rests on a bead 68 of suitable sealing material, such as butyl.

Figure 6:
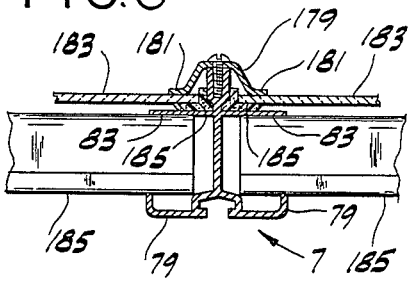
FIG. 6 is a section taken on line 6—6 of FIG. 5.

The cap member 87 shown in FIGS. 2 and 3 is designed for use with relatively thick (⅝ in.) "Exolite" glazing. For other types and thicknesses of glazing, different cap members may be used, such as the cap member 179 shown in FIG. 6, which is adapted for use on side and roof bars with ⅛ in. thick glazing. As shown, this cap member is of inverted-channel shape and has outwardly-turned side margins 181 extending longitudinally of the cap member. When the cap member is secured in the position shown in FIG. 6, these side margins 181 lie flat against the outer faces of sheets 183 of glazing, the latter of which are supported by the arms 83 of the side bar 7 (or roof bar 9). Seals 184 of butyl, for example, are provided between the arms and the glazing.

It will be apparent, therefore, that the framing system of this invention includes a plurality of different cap members, each having a different configuration and being adapted for use with sheets of glazing of a different type and thicknesses. It will be understood, however, that all of the cap members of the system are usable with the same side, roof and corner bars 7, 9 and 11.

When relatively thin (e.g., ⅛ in.) glazing is used, the sheets are generally narrow and shorter than sheets of thicker glazing. Consequently, extruded metal support bars, each designated 185 in FIGS. 5 and 6, may be installed to extend generally horizontally between the vertical side bars 7 and between the sloping roof bars 9 to provide additional support to the glazing along adjacent edges of adjacent sheets of glazing. The support bars 185 are generally of channel shape (see FIG. 5) and have an overall height (or depth) such that the ends of the bars are snugly receivable between the legs 79 and arms 83 of the side and roof bars 9, 11 (see FIG. 6) and between the flange 165 and extension 151 of a corner bar 11. A cap identical to cap 87 may be used to close the gap between adjacent edges of the sheets, the cap being fastened in place by screws threaded through the gap into a U-shaped formation 186 running the length of the support bar. A suitable sealing material or insert (not shown) may be placed between the support bar and the glazing to provide the proper support.

Referring again to FIG. 5, it will be noted that for thinner roof glazing, such as ⅛ in. plate glass of the type indicated at 187, adaptors 111 are not used. Instead, the lower edges of the glazing are supported by a relatively short integral lip 189 projecting up from the top wall of the eave member. A bead 191 of suitable sealing material is provided between the lip 189 and the glazing to provide a seal. When adaptors 111 are used with thicker glazing, holes should be field-drilled in the lip 189 in register with holes 123 in the adaptors to permit proper drainage.

Figure 8:
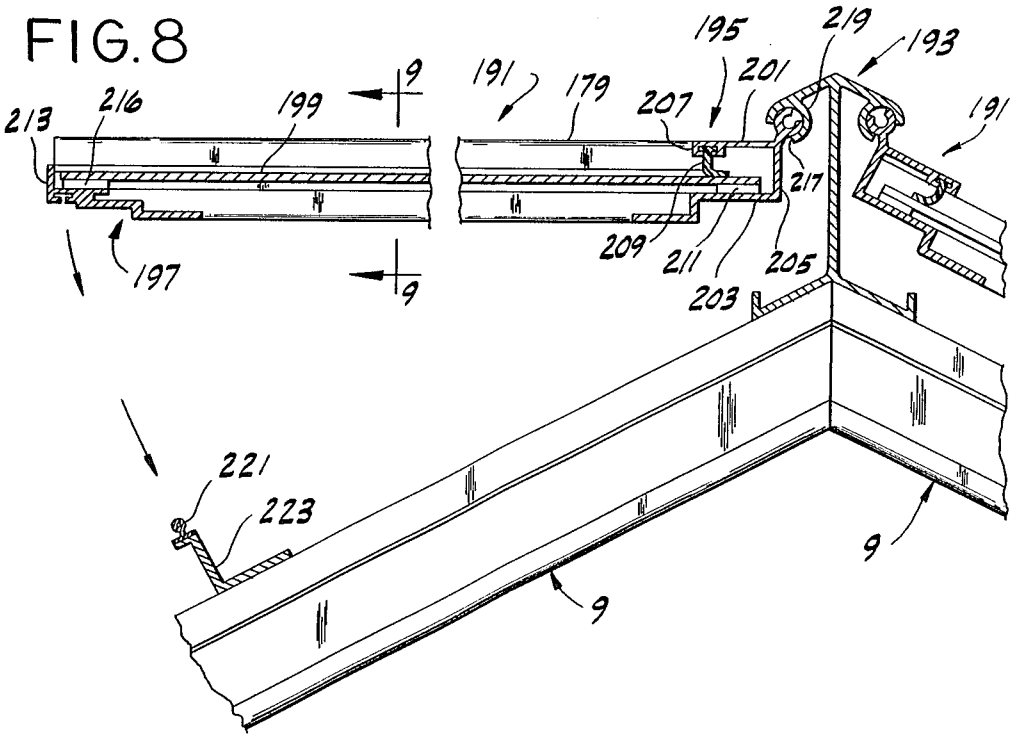
FIG. 8 is an enlarged vertical section through the ridgeline of the roof showing a vent construction.

FIG. 8 is a view illustrating a vent construction of the present invention, two vents each designated 191 being depicted. As illustrated, the vents are supported on opposite sides of a ridge bar generally designated 193 extending along the ridge of the roof where the mitered ends of the sloping roof bars 9 and cap members (e.g., 87) meet. Each vent 191 comprises an upper rail generally indicated at 195 and a lower rail generally indicated at 197 for supporting the upper and lower edges of a sheet 199 of vent glazing.

The upper rail 195 is a generally channel-shaped member comprising upper and lower flanges 201, 203 and a connecting web 205, the flanges being spaced apart a distance sufficient to accommodate glazing of various types and thicknesses. An channel-shaped holder 207 is integrally formed at the outer end of the upper flange 201 and carries a sealing member 209 which seals against the upper (outer) face of vent glazing 199. The upper edge of the vent glazing preferably bears on a bead 211 of sealing material on the lower flange 203.

The lower rail 197 comprises a generally L-shaped member having a relatively short leg 213 projecting up at the bottom of the vent and a longer leg 215 underlying the vent glazing 199. The lower edge of the glazing preferably bears on a bead 216 of sealing material on leg 215.

A pivot member 217 formed on the upper rail 195 pivots in a hinge 219 on the ridge bar 193 to enable the each vent 191 to be swung about a generally horizontal axis between open and closed positions. In its closed position, the lower rail 197 of the vent is adapted to engage a sealing member 221 on an angle bar 223 secured to the roof to provide a suitable seal.

Figure 9:
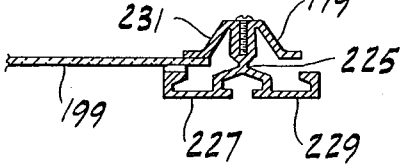
FIG. 9 is a partial vertical section on line 9—9 of FIG. 8.

The side construction of vent 219 is illustrated in FIG. 9 as comprising a vent side bar 225 having in cross section legs 227 and 229 and a head 231. Leg 227 supports a side edge margin of the vent glazing. A cap member designated 179 (since it is identical to cap member 179 previously described) is secured to the head 231 of the vent side bar and seals against the upper side margin of the vent glazing.

Essentially the same vent construction 191 may be used in conjunction with the eave member 3, the only difference being that the vent is disposed generally vertically with the pivot member 217 swingable in hinge 27 (see FIG. 1) on the front flange 23 of the eave member. In this construction, flange 213 of the lower rail is adapted to be supported by shelf 71.

It will be apparent from the foregoing that the universal framing system 1 of this invention can be used for glazing of substantially any thickness within a wide range of thicknesses. The method of using the system to accomplish this result should also be clear from the prior description and the drawings. Generally, however, the structural framing 13 (e.g., columns, roof trusses and roof purlins) is first erected and the eave members 3, roof bars 9, ridge bars 193 and roof vents 191 installed. Sill members 5 are then mounted in position the appropriate distance below the eave members, with the rear wall 43 of each sill member generally in the same vertical plane as the rear wall 21 of the eave member thereabove. The vertical side bars 7 are then installed at intervals corresponding to the widths of the sheets of glazing, with the upper and lower ends of each bar immediately forward of the walls 21 and 43, respectively. The support bars 186 and corner bars 11 are then installed.

After the various components of the framing system 1 are in place, the various sealing members 31, 173, 175 and/or 177 are installed in the appropriate holders on the eave members 3, sill members 5 (when appropriate) and corner bars 11. It will be understood that the type and number of sealing members are selected according to the type and thickness of glazing used, as noted. The glazing to be used is then placed in position and the appropriate cap members applied to secure the glazing in place.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A universal framing system adapted for use with glazing having substantially any thickness within a wide range of thicknesses, said system comprising an elongate eave member having a top wall, a first flange depending from the top wall and extending longitudinally of the eave member generally adjacent the front of the eave member, a second flange depending from the top wall and extending longitudinally of the eave member generally parallel to the first flange, said second flange being spaced rearwardly from the first flange whereby the upper edge margin of a sheet of wall glazing may be inserted upwardly between the flanges to a position in which the sheet lies in a generally vertical plane generally parallel to said flanges, the spacing between the flanges being sufficient to accommodate a sheet having substantially any thickness within said range of thicknesses, one of more sealing members adapted for sealing engagement with said sheet of glazing, means on said first flange for holding one flexible sealing member constituting a first flexible sealing member in position for sealing engagement with the front face of said sheet, and means on said second flange for holding another sealing member constituting a second flexible sealing member in position for sealing engagement with the rear face of said sheet, said one or more sealing members being sized to seal against a relatively thin sheet of glazing yet having a flexibility sufficient to accommodate a relatively thick sheet of glazing.

2. A universal framing system as set forth in claim 1 wherein said holding means on said first flange comprises a channel-shaped holder opening rearwardly toward the first face of said sheet.

3. A universal framing system as set forth in claim 2 wherein said holding means on said second flange comprises a channel-shaped holder opening forwardly toward the rear face of said sheet.

4. A universal framing system as set forth in claim 3 wherein said channel-shaped holders are integrally formed with said first and second flanges.

5. A universal framing system as set forth in claim 4 wherein said eave member is an extruded metal member.

6. A universal framing system as set forth in claim 1 further comprising an adaptor releasably attachable to the top wall of the eave member adapted for engagement with the forward edge of a sheet of roof glazing to prevent the glazing from moving generally forwardly in the plane of the sheet.

7. A universal framing system adapted for use with glazing having substantially any thickness within a wide range of thicknesses, said system comprising an elongate eave member having a top wall, a first flange depending from the top wall and extending longitudinally of the eave member generally adjacent the front of the eave member, a second flange depending from the top wall and extending longitudinally of the eave member generally parallel to the first flange, said second flange being spaced rearwardly from the first flange whereby the upper edge margin of a sheet of wall glazing may be inserted upwardly between the flanges to a position in which the sheet lies in a generally vertical plane generally parallel to said flanges, the spacing between the flanges being sufficient to accommodate a sheet having substantially any thickness within said range of thicknesses, means on said first flange for holding a first sealing member in position for sealing engagement with the front face of said sheet, means on said second flange for holding a second sealing member in position for sealing engagement with the rear face of said sheet, and a plurality of sets of sealing members, each set comprising one or more sealing members, the sealing member or members of each set having a shape different from the sealing member or members of the other sets and being adapted for use with sheets of glazing of specified thickness within said range of thicknesses.

8. A universal framing system adapted for use with glazing having substantially any thickness within a wide range of thicknesses, said system comprising an elongate eave member having a top wall, a first flange depending from the top wall and extending longitudinally of the eave member generally adjacent the front of the eave member, a second flange depending from the top wall and extending longitudinally of the eave member generally parallel to the first flange, said second flange being spaced rearwardly from the first flange whereby the upper edge margin of a sheet of wall glazing may be inserted upwardly between the flanges to a position in which the sheet lies in a generally vertical plane generally parallel to said flanges, the spacing between the flanges being sufficient to accommodate a sheet having substantially any thickness within said range of thickness, means on said first flange for holding a first flexible sealing member in position for sealing engagement with the front face of said sheet, and an adaptor releasably attachable to the top wall of the eave member for holding a sheet of roof glazing in fixed position, said adaptor being generally U-shaped in cross section with upper and lower legs adapted slidably to receive therebetween an edge margin of said sheet of roof glazing, the lower leg of the adaptor and the top wall of the eave member having interfitting components for releasably attaching the adaptor to the eave member.

9. A universal framing system adapted for use with glazing having substantially any thickness within a wide range of thicknesses, said system comprising an elongate eave member having a top wall, a first flange depending from the top wall and extending longitudinally of the eave member generally adjacent the front of the eave member, a second flange depending from the top wall and extending longitudinally of the eave member generally parallel to the first flange, said second flange being spaced rearwardly from the first flange whereby the upper edge margin of a sheet of wall glazing may be inserted upwardly between the flanges to a position in which the sheet lies in a generally vertical plane generally parallel to said flanges, the spacing between the flanges being sufficient to accommodate a sheet having substantially any thickness within said range of thicknesses, means on said first flange for holding a first flexible sealing member in position for sealing engagement with the front face of said sheet, and means on said second flange for holding a second sealing member in position for sealing engagement with the rear face of said sheet, said eave member having a rear wall depending from its top wall at the rear of the eave member, and a supporting rib extending rearwardly from the rear wall at a level below the top wall of the eave member for supporting a roof bar of the framing system.

10. A universal framing system as set forth in claim 9 further comprising a roof bar adapted to be supported by said supporting rib on the eave member, said roof bar having in transverse section a web, a pair of generally coplanar arms extending from opposite sides of the web generally at right angles to the web and terminating in outer free ends lying generally in the plane of the arms, each arm being adapted for flatwise engagement along a substantial portion of its length by an edge margin of a sheet of roof glazing to support the sheet of roof glazing, and a head above the web, said system further comprising an elongate cap member having longitudinally extending side margins, and means for securing the cap member to the head of the roof bar in a position in which the side margins of the cap member are spaced above the arms of the roof bar for receiving therebetween the edge margins of said sheets of roof glazing supported on the arms.

11. A universal framing system as set forth in claim 10 wherein said cap member is of inverted channel shape having outwardly turned side margins adapted for sealing engagement with the edge margins of said sheets of roof glazing.

12. A universal framing system as set forth in claim 10 wherein the side margins of said cap member are formed for holding a set of flexible sealing members in position for sealing engagement with the edge margins of sheets of roof glazing supported on the arms of the roof bar.

13. A universal framing system as set forth in claim 12 wherein the side margins of the cap member are formed with channel-shaped holders adapted to hold said sealing members therein with the sealing members projecting downwardly for engagement with the edge margins of said sheets of roof glazing.

14. A universal framing system as set forth in claim 9 further comprising a roof bar adapted to be supported by said supporting rib on the eave member, said roof bar having in transverse section a web, a pair of generally coplanar arms extending from opposite sides of the web generally at right angles to the web, each arm being adapted to support an edge margin of a sheet of roof glazing, and a head above the web, said system further comprising an elongate cap member having longitudinally extending side margins, and means for securing the cap member to the head of the roof bar in a position in which the side margins of the cap member are spaced above the arms of the roof bar for receiving therebetween the edge margins of said sheets of roof glazing supported on the arms, said system further comprising a plurality of elongate cap members, each having a different configuration and being adapted for use with sheets of glazing of specified thickness without varying the structure of said roof bar.

15. A universal framing system as set forth in claim 9 further comprising a side bar adapted to be mounted in vertical position with its upper end immediately forward of the rear wall of the eave member, said side bar having in horizontal transverse section a web, and a pair of generally coplanar arms extending from opposite sides of the web generally at right angles to the web and terminating in outer free ends lying generally in the plane of the arms, said arms being adapted for flatwise engagement along a substantial portion of their lengths by edge margins of adjacent sheets of wall glazing extending in a vertical plane generally parallel to the plane of the arms, an elongate cap member having longitudinally extending side margins, and means for securing the cap member in generally vertical position to the side bar with the side margins of the cap member spaced outwardly from the arms of the side bar for receiving said edge margins of said sheets therebetween.

16. A universal framing system as set forth in claim 15 further comprising a sill member having a top wall adapted for supporting the lower end of said side bar, a rear wall at the rear of the sill member, a front wall having a ledge projecting forwardly therefrom at a level below the top wall for supporting the lower edge of a vertical sheet of glazing, and a structure on the front wall of generally inverted-channel shape having a web and a pair of depending generally parallel flanges extending longitudinally of the sill member, one flange constituting a front flange and the other a rear flange, said flanges being spaced from one another for receiving therebetween an edge margin of a sheet of wall glazing lying in a generally vertical plane running generally parallel to said flanges, the spacing between the flanges being sufficient to accommodate a sheet having substantially any thickness within said range of thicknesses, and means on the front flange for holding a flexible sealing member in position for sealing engagement with the front face of said sheet.

17. A universal framing system as set forth in claim 16 wherein said rear wall projects above the top wall of the sill member, the lower end of said side bar being adapted to be positioned immediately forward of the rear wall of the sill member.

18. A universal framing system as set forth in claim 16 wherein said means on the front flange for holding said sealing member comprises a channel-shaped holder extending longitudinally of the sill member for holding said sealing member.

19. A universal framing system as set forth in claim 16 wherein the rear flange of said structure is spaced forward of the rear wall of the sill member to receive therebetween a side bar of the system.

20. A universal framing system as set forth in claim 16 further comprising a sealing bar adapted to be secured to said sill member and having means thereon for holding a sealing member in sealing engagement with the front face of a sheet of wall glazing supported on the ledge of the sill member.

21. A universal framing system as set forth in claim 9 further comprising a side bar adapted to be mounted in vertical position with its upper end immediately forward of the rear wall of the eave member, said side bar having in horizontal transverse section a web, and a pair of generally coplanar arms extending from opposite sides of the web generally at right angles to the web, said arms being adapted for flatwise engagement by edge margins of adjacent sheets of wall glazing extending in a vertical plane generally parallel to the plane of the arms, an elongate cap member having longitudinally extending side margins, and means for securing the cap member in generally vertical position to the side bar with the side margins of the cap member spaced outwardly from the arms of the side bar for receiving said edge margins of said sheets therebetween, said system further comprising a plurality of elongate cap members, each having a different configuration and being adapted for use with sheets of glazing of specified thickness without varying the structure of said side bar.

22. A universal framing system adapted for use with glazing material having substantially any thickness within a wide range of thicknesses, said system comprising a corner bar having first and second exterior walls extending generally at right angles with respect to one another, an interior leg extending inwardly from the second exterior wall generally parallel to the first exterior wall and spaced therefrom for receiving therebetween an edge margin of a first sheet of glazing extending in a plane generally parallel to the first exterior wall and interior leg, the spacing between the first exterior wall and interior leg being sufficient to accommodate a sheet of glazing having substantially any thickness within a wide range of thicknesses, and means on the first exterior wall for holding a first sealing member in position for sealing engagement with one face of said sheet of glazing.

* * * * *